US006985598B1

(12) United States Patent
Joschika

(10) Patent No.: US 6,985,598 B1
(45) Date of Patent: Jan. 10, 2006

(54) PROGRAMMING SYSTEM FOR PROGRAMMING HEARING AIDS

(75) Inventor: Thomas Konrad Joschika, Pondorf (AT)

(73) Assignee: Knowles ELectronics, Inc., Itasca, IL (US)

( * ) Notice: Subject to any disclaimer, the term of this patent is extended or adjusted under 35 U.S.C. 154(b) by 435 days.

(21) Appl. No.: 09/364,625

(22) Filed: Jul. 29, 1999

(51) Int. Cl.
*H04R 25/00* (2006.01)

(52) U.S. Cl. ..... 381/323; 381/312; 381/314; 381/322

(58) Field of Classification Search ..... 381/323, 381/322, 328, 312, 314, 324, 330
See application file for complete search history.

(56) References Cited

U.S. PATENT DOCUMENTS 4,961,230 A * 10/1990 Rising ..... 381/323
5,412,736 A * 5/1995 Keliiliki ..... 381/330
5,799,095 A 8/1998 Hanright
6,088,465 A * 7/2000 Hanright ..... 381/323

FOREIGN PATENT DOCUMENTS

DE EP 0 341902 A 11/1989
DK DE 44 44 586 C 2/1996

* cited by examiner

*Primary Examiner*—Vivian Chin
*Assistant Examiner*—Justin Michalski
(74) *Attorney, Agent, or Firm*—Marshall, Gerstein & Borun LLP

(57) ABSTRACT

A system for programming hearing aids utilizing a multi-electrode programming strip. The strip is removably attached to a connector and inserted into the aid through a narrow slot in the faceplate; the slot is bounded by the faceplate and by one of the edges of the battery door. When the door is closed, the strip (and the electrodes thereon) is urged against corresponding terminals located inside the aid.

20 Claims, 7 Drawing Sheets

PROGRAMMING SYSTEM FOR PROGRAMMING HEARING AIDS

TECHNICAL FIELD

The present invention relates to hearing aids, and in particular to an apparatus and method for making an electrical connection between a programmable hearing aid and a programming unit.

BACKGROUND OF THE INVENTION

Programmable hearing aids have certain characteristics (e.g., frequency response, attack and release times, automatic gain control, etc.) that are adjustable by a hearing aid dispenser. Conventionally, such hearing aids are programmed in situ, i.e., while they are in the patient's ear. This permits the patient and dispenser to evaluate the programming of the hearing aid and to adjust the programming if the performance of the hearing aid is substandard.

U.S. Pat. No. 5,799,095 to Hanright relates to a hearing aid programming system whereby electrical connections necessary to program the hearing aid are accessed through a slot adjacent to the battery access door of the hearing aid. In this system, the access door is opened and the end portion of a cable is inserted in the slot beside the door. The door is then closed to provide a connection between the hearing aid and a programming unit by crimping the cable against electrical leads within the hearing aid.

After using the cable several times, the end portion of the cable that is inserted into the hearing aid can wear and fail to provide an adequate electrical connection between the hearing aid and the programming unit. Accordingly, the entire cable must be replaced.

SUMMARY OF THE INVENTION

In accordance with the invention, a system is provided for programming a hearing aid having a housing, a faceplate attached to the housing, a programmable hearing aid circuit contained within the housing, a plurality of programming terminals located inside the housing and electrically connected to the circuit, and a battery door.

The faceplate has an opening for receiving the battery door. The door is hingedly connected to the faceplate so it is moveable between an open position and a closed position. An edge of the door is spaced apart from the faceplate to define a narrow slot bounded by the edge and the faceplate. The slot is adjacent the programming terminals.

The programming system includes a connector operably attached to a programming unit and also removably receiving a multi-electrode programming strip. The strip is dimensioned to fit into the slot of the hearing aid and has a like plurality of electrodes dimensioned to mate with the hearing aid terminals. The strip is dimensioned to cooperate in a manner that when the strip has been fully inserted into the housing through the slot with the electrodes facing the terminals and the door is in the closed position, the electrodes are pressed against the terminals and make electrical contact therewith.

BRIEF DESCRIPTION OF THE DRAWINGS

The invention will be better understood with reference to the following illustrative and non-limiting drawings, in which.

DETAILED DESCRIPTION OF PREFERRED EMBODIMENTS

Figure 1:
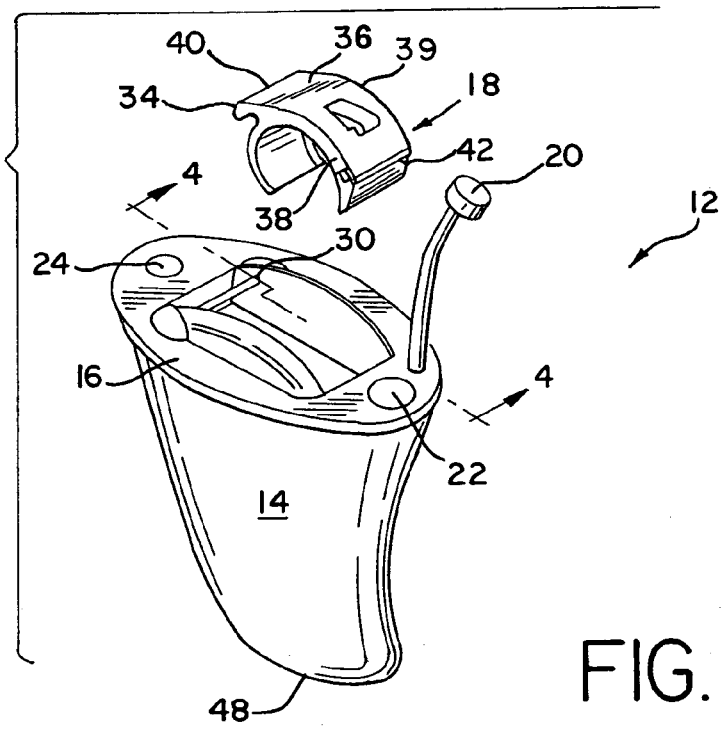
FIG. 1 (Prior Art)
FIG. 1 is an enlarged partially exploded perspective view of a conventional programmable completely-in-canal hearing aid having a battery door.
Figure 2:
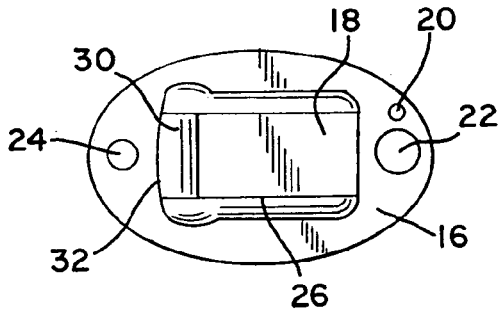
FIG. 2 (Prior Art)
FIG. 2 is an enlarged top view of the hearing aid of FIG. 1.
Figure 3:
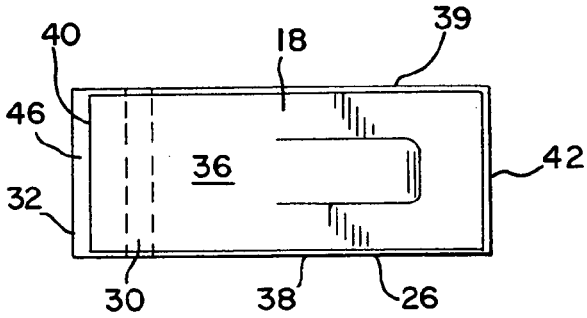
FIG. 3 (Prior Art)
FIG. 3 is an enlarged top view about the battery door of the hearing aid of FIG. 1.

A programmable completely-in-canal hearing aid 12 is depicted in FIG. 1. The hearing aid 12 includes a housing 14 and a faceplate 16. The faceplate 16 closes off the hearing aid housing 14 and supports a battery door 18, a retrieval line 20, and a microphone 22. The faceplate 16 also includes a vent 24 and a rectangular opening 26 (FIGS. 2 and 3).

The opening 26 is shaped to mate with the battery door 18 described below, and is rectangular because conventional battery doors (e.g., door 18) fit into rectangular openings. However, it is possible to use an opening 26 of another shape.

Figure 4:
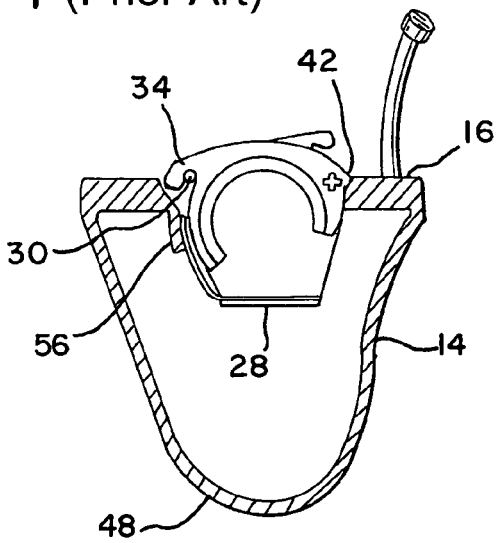
FIG. 4 (Prior Art)
FIG. 4 is a cross sectional view of the hearing aid of FIG. 1 along plane 4—4.

The battery door 18 is conventional and designed to receive a hearing aid battery (not shown) and hold the battery in position as the battery door is opened and closed. When a battery is located in the battery door 18 and the door is closed, the anode and cathode of the battery are urged against corresponding terminals (not shown) within the hearing aid 12 to provide power to circuit 28 (FIG. 4) discussed below. Such terminals are conventional and are not discussed further.

As is conventional in this art, to provide a hinge for the battery door 18, the faceplate 16 is provided with a metal pin 30 embedded at its ends in the faceplate. The pin 30 is adjacent one end 32 of the opening 30 (FIGS. 2 and 3). The battery door 18 is provided with a snap-in clip 34 that snaps onto the pin 30 to hingedly secure the door 18 to the faceplate 16 and thereby allow the door to be opened and closed.

Figure 5A:
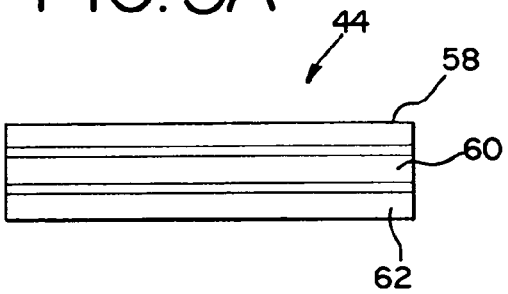
FIGS. 5A and 5B are an enlarged plan view and a bottom view, respectively, of a programming strip to be received within the slot beside the battery door of the hearing aid of FIG. 1.
Figure 5B:
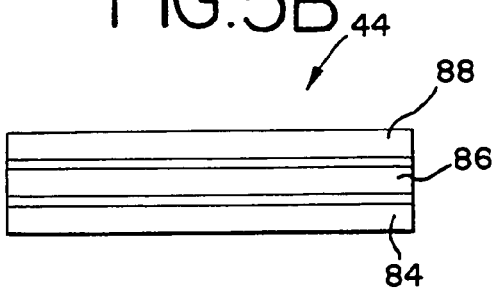
Figure 6:
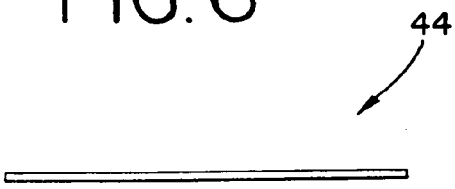
FIG. 6 is a side view of the programming strip of FIGS. 5A and 5B.

The exterior surface 36 of the door 18 has four edges; two elongated sides 38 and 39, a proximal end 40 and a distal end 42. In conventional fashion, mating regions on the faceplate 16 and the distal end 42 form a latch that keeps the door 18 latched when in the closed position. The door 18 is dimensioned to have the closest possible fit within the opening 26, except along one of the edges 36, 38, 40 and 42. Along this edge, the door 18 is slightly undersized, forming a slot that is bounded by the edge and by the opening 26. As will be described in more detail below, this slot is used as an access port into which a flexible programming strip 44 (see FIGS. 5 and 6) is inserted to program the hearing aid 12.

The slot 46 is bounded by the proximal end 40 of the door 18 and the end 32 of the opening 26. (See FIG. 3.) This makes it possible to use a completely conventional battery door 18. However, it is possible to locate the slot 46 elsewhere around the door 18.

In an embodiment, the slot 46 is 4 mils wide to accommodate a programming strip made of conventional 3.8 mil flexible printed circuit board. To achieve this thickness, it is necessary to make the faceplate 16, the pin 30 and the door 18 to tight tolerances. However, if desired, the slot 46 can have a different width.

A programmable hearing aid circuit 28 (FIGS. 4, and 13–15) is provided inside the housing 14. The circuit 28 is connected directly or indirectly to the microphone 22 and to the receiver (not shown) located in the medial tip 48 of the hearing aid. In the preferred embodiment, the circuit 28 is designed with power supplied to the circuit from the battery (not shown), three terminals 50, 52, 54 (see FIG. 15) are sufficient to program the circuit and to read the settings that have been programmed into it. However, in alternative embodiments, more or fewer terminals can be used instead.

The terminals 50, 52 and 54 are located on a support 56 integral with the faceplate 16. The support 56 is curved to follow the shape of the battery door 18 when the battery door is in the closed position. The terminals 50, 52 and 54 are part of a flexible copper-Kapton printed circuit board 57 connected to the circuit 28. Alternatively, the terminals 50, 52, 54 can be individual components embedded in the support 56 and connected to the circuit 28 such as by hard-wiring.

A programming strip 44 such as illustrated in FIGS. 5, 6, 13 and 14 is used to program the hearing aid 12. Advantageously, the strip 44 is flexible and 3.8 mils thick, and is formed using copper as the electrical conductors and Kapton as the substrate. As will be seen below, the strip 44 is designed so it operates properly regardless of the direction in which it is inserted into the slot 46. However, for clarity, the operation of the programming strip 44 will first be explained with reference to its three electrodes 58, 60 and 62.

Figure 12:
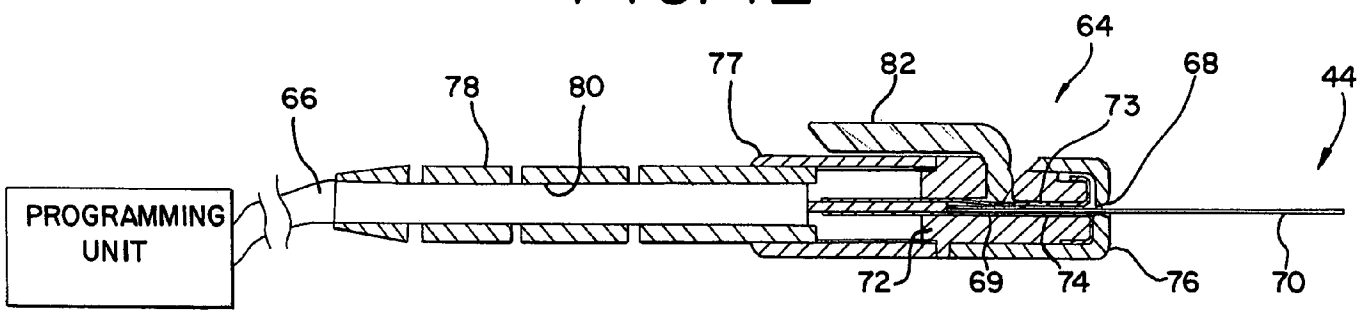
FIG. 12 is similar to FIG. 11 with the programming strip received by the connector and the latch in the closed position.

The electrodes 58, 60 and 62 are dimensioned to mate with the terminals 50, 52 and 54 respectively. The electrodes 58, 60 and 62 are operably connected to an external programming unit (FIG. 12) via a connector 64 (FIGS. 10–14) attached to a cable 66. The programming unit provides electrical signals to the electrodes 58, 60 and 62, and when these electrodes 58, 60 and 62 are connected to the terminals 50, 52 and 54 and the battery is installed, these signals are used to program the circuit 28.

The programming strip 44 is dimensioned to fit into the slot 46 adjacent the battery door 18. If desired, the strip 44 can be ridged and the support 56 and printed circuit board 57 can be grooved to match. The programming strip 44 can also be thicker at its distal end than at its proximal end. Persons skilled in the art can adapt the shapes of the strip 44 and the support 56 to serve in whatever particular application is desired.

Turning to FIGS. 7–12, an opening 68 in the connector 64 provides for receiving a portion 69 of the programming strip 56 while allowing another portion 70 of the strip extending from the connector 64 to be inserted into the hearing aid 12. The connector 64 includes a plurality of electrically conductive metal or metal alloy contacts 70 mounted to an electrically insulative plastic base block 72. The contacts 70 are arranged into an adjustable group 73 of three contacts and a corresponding fixed group 74 of three contacts mounted on opposite sides of block 72. Accordingly, the adjustably contact group 73 is spaced from the fixed group 74 by a distance adequate for insertion of the programming strip between the contact groups.

The connector 64 includes a plastic housing having a front cap 76 and a rear cap 77. The front cap 74 receives a portion of the base block 72 and the distal end portions of both the adjustable and fixed contact groups 73 and 74, respectively. The rear cap 77 also receives a portion of the base block 72 and the proximal end portions of the adjustable and fixed contact groups 73 and 74. Further, the rear cap 77 receives the proximal end of a cable strain relief member 78 wherein cable 66 extends into through a longitudinal bore 80 passing through the strain relief member.

The cable 66 includes a plurality of electrical leads operably attached by conventional means to the contacts 70 within the connector 64. Also, as stated previously, the cable 66 is operably connected to a hearing aid programming unit.

Pivotally mounted to the connector 64 is a locking lever arm 82 that can be moved by a user between a programming strip release position and a clamping position. The lever arm 82 abuts against the adjustable group 73 of contacts 70. Movement of the lever arm 82 to the clamping position (i.e., FIGS. 8, 9 and 12) results in the arm moving and locking the adjustable group 73 of contacts 70 toward the fixed group 74 of contacts. Accordingly, the portion 69 of the programing strip 44 within the connector 64 is clamped between the adjustable group 73 of contacts 70 and the fixed group 74 of contacts. Moreover, the connector contacts 70 are brought into contact with the electrodes 58,60,62 of the programming strip 44. This results in the hearing aid programming unit being operably connected to the programing strip electrodes 58,60,62.

The lever arm 82 is held in the clamping position by the memory of the adjustably group 73 of contacts 70 resiliently applying pressure against the lever arm to maintain its position. However, the lever arm 82 can be released from the clamping position by a user applying adequate force to overcome the pressure applied by the adjustably group 73 of contacts 70.

Figure 13:
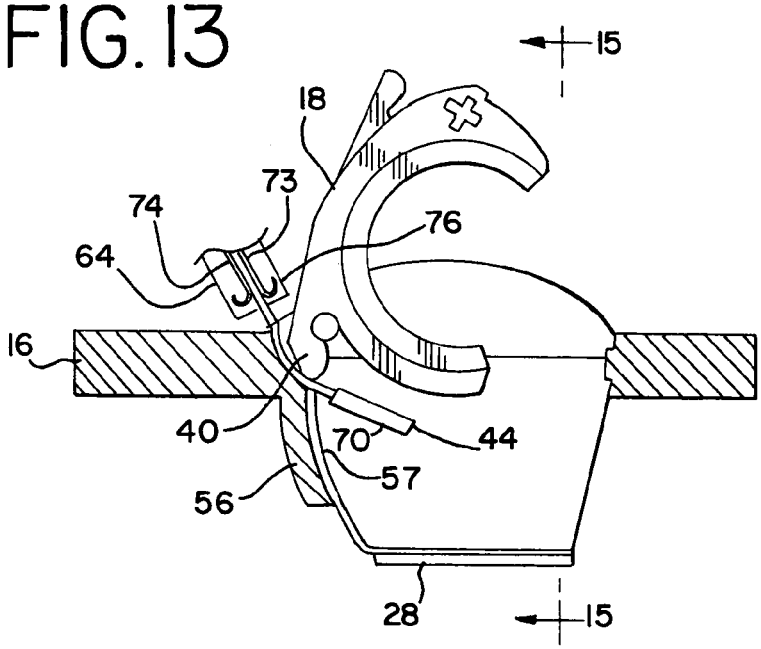
FIGS. 13 and 14 show the programming strip inserted into the hearing aid with the battery door open and closed, respectively.
Figure 14:
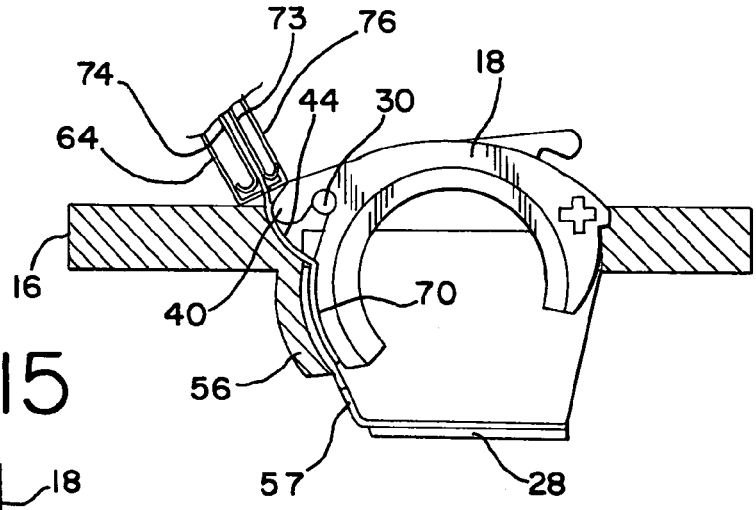
Figure 15:
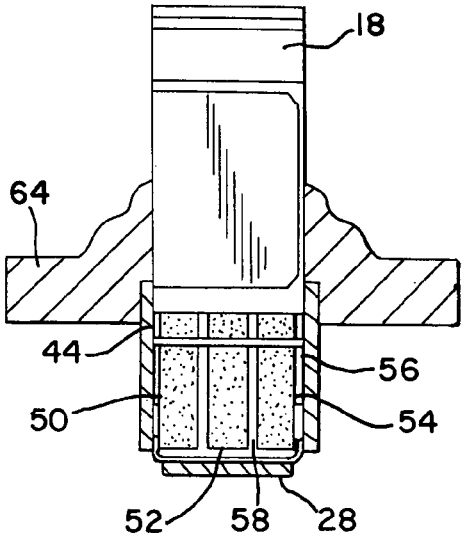
FIG. 15 is a cross sectional view along plane 15—15 of FIG. 13.
Figure 16A:
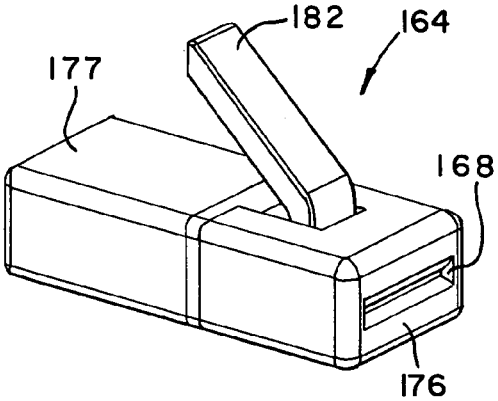
FIGS. 16A–F depicted various views of an alternative embodiment of a connector for removably receiving the programming strip of FIG. 7 an operably connecting the strip to a programming unit.
Figure 16B:
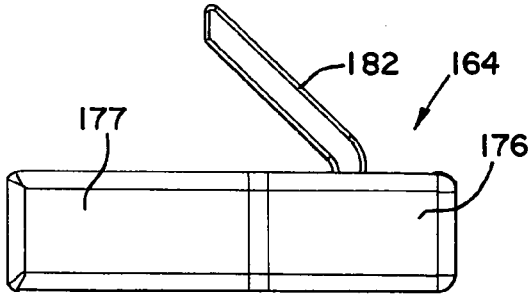
Figure 16C:
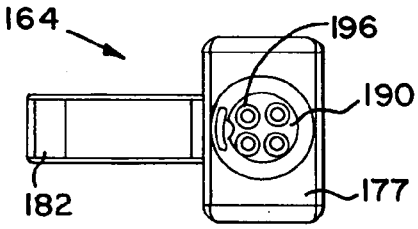
Figure 16D:
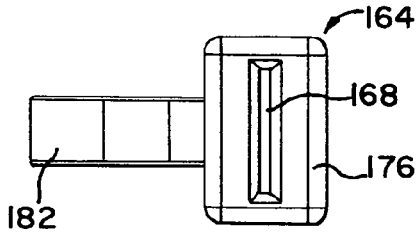
Figure 16E:
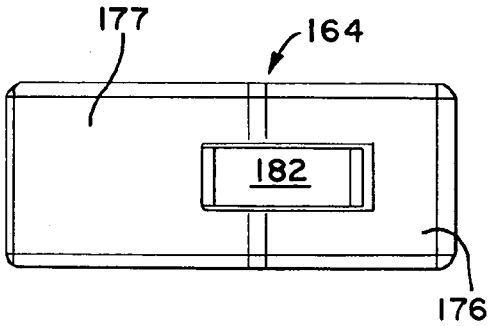
Figure 16F:
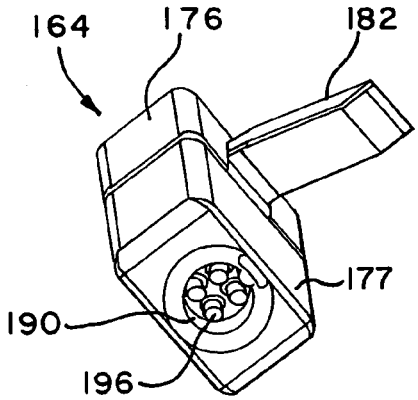
Figure 17:
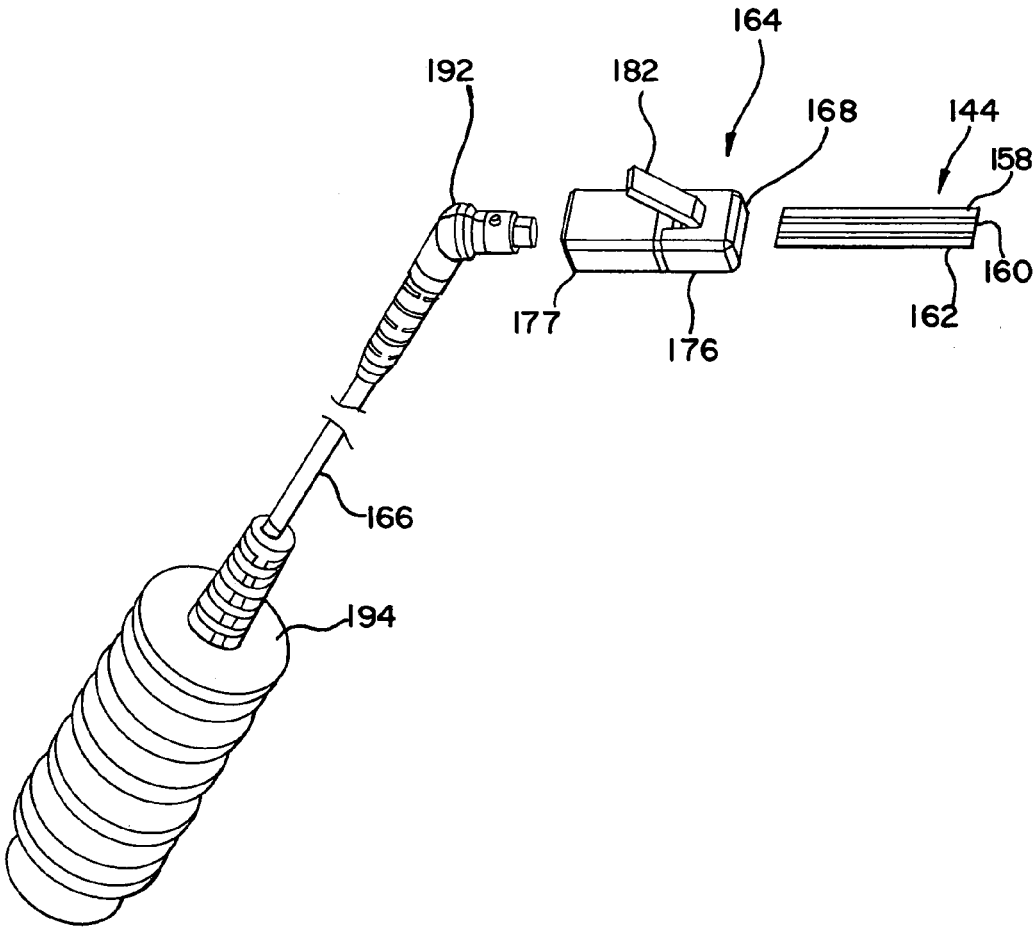
FIG. 17 is an assembly view of the connector of FIG. 16 for removably receiving the programming strip an operably attached to a programming unit via a cable assembly.

Turning to FIGS. 13 and 14, to program the hearing aid 12, the battery door 18 is opened and a battery (not shown) is placed therein. The programing strip 44 is then inserted into the slot 46 in such a manner that the electrodes 58, 60 and 62 face the terminals 50, 52 and 54. Insertion can continue until the connector 64 strikes the faceplate 16 or another part of the aid. As can be seen in FIG. 13, the programming strip 44 is then suspended between the door 18 and the printed circuit board 57.

When the battery door 18 is closed, it presses the programming strip 44 against the printed circuit board 57 so the electrodes 58, 60 and 62 make electrical contact with the terminals 50, 52 and 54 respectively. At the same time, the battery (not shown) is connected to the circuit 28. In this condition, the circuit 28 can be programmed by, or read by, the programming unit.

In the preferred embodiment, the strip 44 actually has electrodes on both sides. On the reverse side, the strip 44 has three electrodes 84, 86 and 88.

Also, each contact 70 in the adjustable group 73 is operably attached by a conductive lead or the like (not show) to an oppositely mounted contact within the fixed group 74. Accordingly, when the programming strip 44 is clamped between the contacts 70 in the adjustably group 73 and fixed group 74, electrodes 84 and 58 are in electrical communication with each other along with the same conductor in the cable 66, electrodes 86 and 60 are in electrical communication with each other along with the same conductor in the cable 66, and electrodes 88 and 62 are in electrical communication with each other along with the same conductor in the cable 66. By using this structure, it does not matter whether the programming strip 44 is inserted into the hearing aid 12 with the electrodes 58, 60, 62 facing the terminals 50, 52, 54, or whether the electrodes 88, 86, 64 face the terminals 50, 52, 54. Similarly, it does not matter whether the programming strip 44 is inserted into the connector 64 with the terminals 50, 52, 54 facing the adjustably group 73 of contacts 70 or the fixed group 74 of contacts.

In the preferred embodiment, the programming strip 44 is advantageously inserted into the hearing aid 12 when the battery door 18 open. This is to minimize wear and physical stress on the strip 44, but it is not required. It is alternatively possible to make strip 44 comparatively rigid and to, e.g., supply springs that would urge the terminals 50, 52, 54 towards the door 18.

Figure 7:
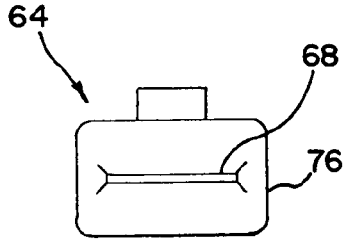
FIG. 7 is an enlarged end view of a connector for removably receiving the programming strip of FIG. 6 and operably attaching the strip to a programming unit.

Turning to FIGS. 16A–F and 17 an alternative embodiment is depicted of a connector for removably receiving the programming strip of FIG. 7 and operably connecting it to a programming unit. In the FIGURES, the last two digits within the 100 series of reference numbers correspond in structure and/or function with like numbered elements previously described.

The front 176 of the connector 164 includes an opening 68 for receiving a programming strip 144. The connector 164 has a lever arm 182 that can be moved and locked to a closed position to secure the a portion of the programming strip 144 within the slot 168 of the connector and to place the electrodes 158,160,162 in electrical communication therewith.

The rear 177 of the connector 164 includes a jack 190 for receiving a plug 192 operably attached to cable 166. Insertion of the plug 192 into the jack 190 establishes a connection between the programming unit and the connector 164, via both cable 166 and a cable connector 194 operably attached thereto. The cable connector 194 provides for removably connecting the cable 166 to the programming unit. Preferably, the jack 190 includes a plurality of pins that are received by corresponding sockets in the plug 192.

Figure 8:
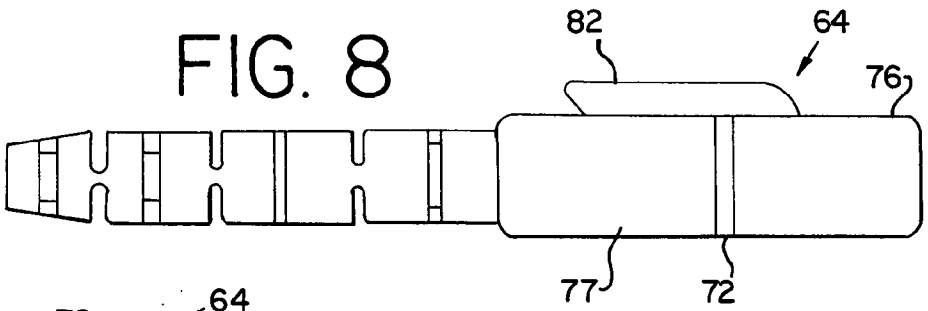
FIG. 8 is a side view of the connector of FIG. 7.
Figure 9:
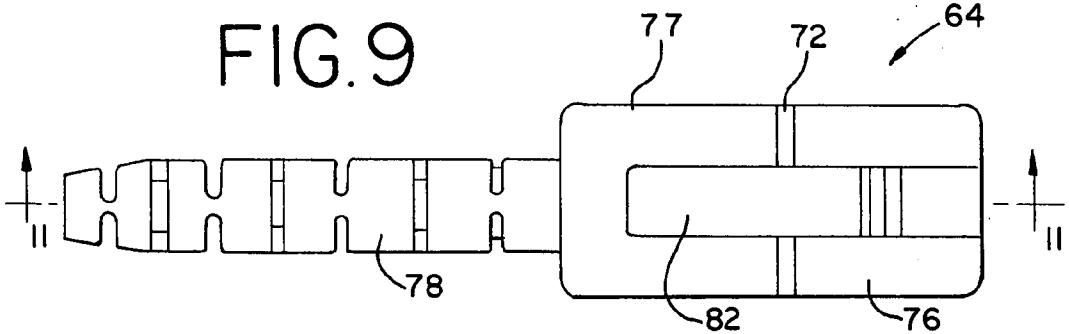
FIG. 9 is a top view of the connector of FIG. 7.
Figure 10:
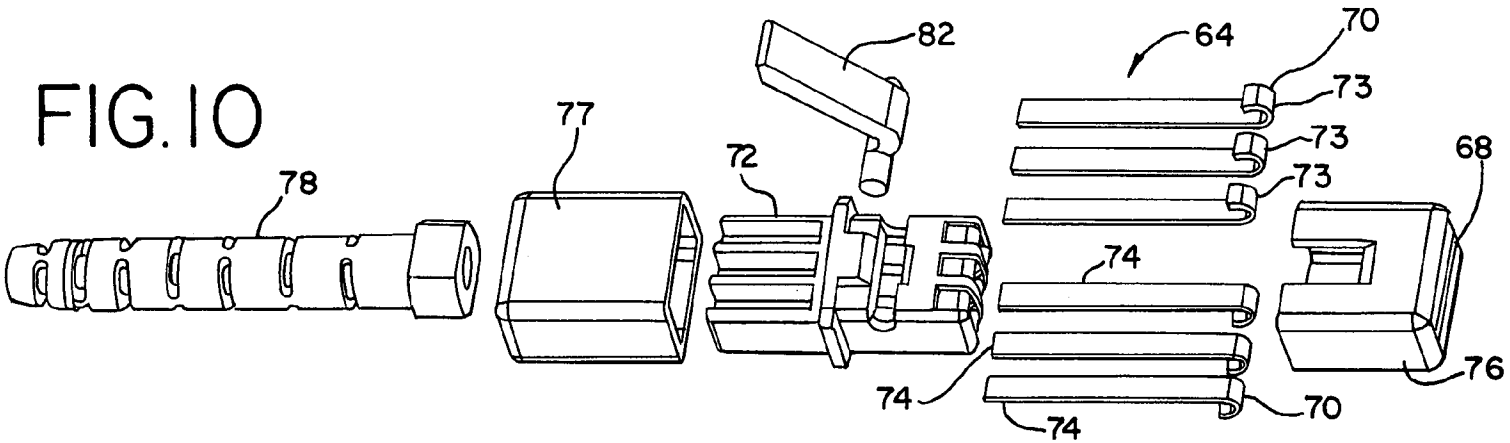
FIG. 10 is a perspective assembly view of the connector of FIG. 7.
Figure 11:
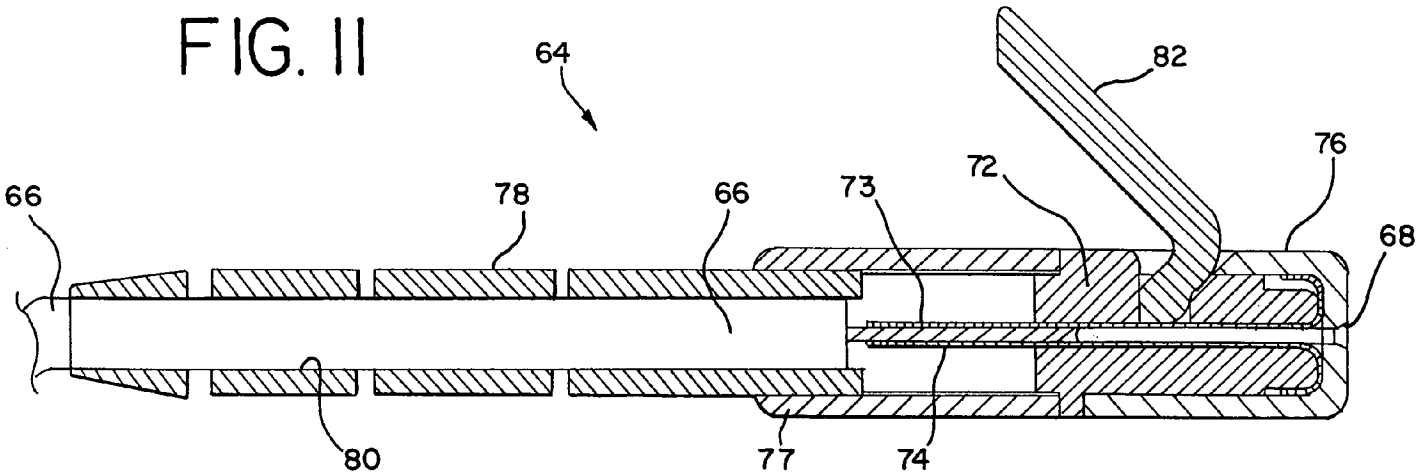
FIG. 11 is a cross sectional view of the connector of FIG. 7 along plane 11—11 of FIG. 9 with a latch in the open position.

In a further alternative embodiment, the jack 190 of the connector 164 can be adapted to receive, and clamp onto, the end of another flexible programming strip extending from a programming cable such at shown in FIGS. 7A, 7B and 8 of U.S. Pat. No. 5,799,095 to Hanright.

Although a preferred embodiment has been described above, the scope of the invention is limited only by the following claims.

I claim:

1. A system for programming a hearing aid with a programming unit, the hearing aid having a plurality of programming terminals within a hearing aid housing and accessible by a slot, the system comprising:

a multi-electrode programming strip dimensioned to fit into the slot of the hearing aid, the strip having a plurality of electrodes dimensioned to mate with the terminals; and, a cable having a first end and a second end, the first end having a connector, the programming strip removably coupled to the connector to allow interchangeability therewith, the second cable end operably attached to the programming unit.

2. The system of claim 1 wherein the connector includes a lever arm operably connected to a group of contacts.

3. The system of claim 2 wherein movement of the lever arm to a clamping position urges the contacts against the programming strip.

4. A method of programming a hearing aid with a programming unit comprising the steps of:

providing a hearing aid having a housing with a plurality of programming terminals therein and accessible by a slot in the housing;

inserting a multi-electrode programming strip into the slot of the hearing aid, the strip having a plurality of electrodes dimensioned to mate with the terminals;

operably coupling the electrodes to the terminals of the hearing aid;

removably coupling the programming strip to a connector on a cable; and, operably attaching the cable to the programming unit.

5. The method of claim 4 wherein the step of removably coupling the programming strip to the connector includes urging at least one contact mounted to the connector against the programming strip.

6. The method of claim 5 wherein the step of urging at least one contact against the programming strip includes moving a lever arm mounted to the connector to a clamping position.

7. A hearing aid programming system, comprising:

a hearing aid housing;

a faceplate attached to the housing and having an opening for receiving a battery door;

a programming hearing aid circuit contained inside the housing;

a plurality of programming terminals electrically connected to the circuit and located inside the housing;

a battery door located within the opening and being hingedly connected to the faceplate so as to be movable between open and closed positions, the door having an edge spaced apart from the faceplate so as to define a narrow slot bounded by said one edge and the faceplate, said slot being adjacent said programming terminals;

a multi-electrode programming strip dimensioned to fit into the slot, the strip having a plurality of electrodes dimensioned to mate with the terminals;

a cable having a first end connectable to a programming unit and a second end having a connector, the programming strip removably coupled to the connector; wherein the door, strip and terminals are dimensioned to cooperate in a manner that when the strip has been fully inserted into the housing through the slot with the electrodes facing the terminals and the door is in the closed position, the electrodes are pressed against the terminals and make electrical contact therewith.

8. The system of claim 7, wherein the strip is flexible.

9. The system of claim 8, wherein the strip is a flexible printed circuit board and the electrodes are printed thereon.

10. The system of claim 8, wherein there are two sets of electrodes, one set located on each side of the printed circuit board.

11. The system of claim 7, wherein there are three terminals.

12. The system of claim 7, wherein the connector is too big to fit into the slot.

13. The system of claim 7, further comprising latch means for latching the door to the faceplate and thereby holding the door in the closed position.

14. The system of claim 7, wherein the housing is a completely-in-canal (CIC) housing.

15. The system of claim 7, wherein the terminals are located on a support that is integral with the faceplate.

16. The system of claim 7, wherein the door has a proximal end and a distal end and said one edge is at one of said ends of the door.

17. The system of claim 7, wherein said one edge is at the proximal end.

18. For a programming system for programming a hearing aid, the hearing aid having a plurality of programming terminals within a hearing aid housing and accessible by a slot, the system including a programming unit and a cable having a first end and a second end, the first end having a connector having a plurality of programming terminals and the cable second end removably, operably attached the programming unit, a multi-electrode programming strip having a first end and a second end, the first strip end dimensioned to fit into the slot of the hearing aid and the second strip end dimensioned to fit into the connector, the strip having a plurality of electrodes dimensioned to mate with the respective programming terminals.

19. For a programming system for programming a hearing aid, the hearing aid having a plurality of programming terminals within a hearing aid housing and accessible by a slot, the system including a programming unit and a multi-electrode programming strip, the strip having a first end, a second end, and a plurality of electrodes extending between the first end and the second end, the first strip end dimensioned to fit into the hearing aid slot to mate with the programming terminals within a hearing aid housing, a cable for coupling the programming unit to the strip, the cable comprising a first end and a second end, the first end having a connector having a plurality of programming terminals and dimensioned to mate with the programming strip electrodes and the cable second end removably, operably attached the programming unit.

20. A multi-electrode programming strip for a programming system for programming a hearing aid, the hearing aid having a plurality of programming terminals within a hearing aid housing and accessible by a slot, the system including a programming unit and a cable connectable thereto at one end, the programming strip having a first end, a second end, and a plurality of electrodes extending between the first end and the second end, the first strip end dimensioned to fit into the hearing aid slot to mate with the programming terminals within the hearing aid housing, the second strip end adapted to be removably connectable to the other end of the cable.

* * * * *

UNITED STATES PATENT AND TRADEMARK OFFICE

CERTIFICATE OF CORRECTION

PATENT NO. : 6,985,598 B1
APPLICATION NO. : 09/364625
DATED : January 10, 2006
INVENTOR(S) : Thomas K. Joschika It is certified that error appears in the above-identified patent and that said Letters Patent is hereby corrected as shown below:

In the Claims:

In Claim 7, column 6, line 45, please delete "a programming" and insert -- a programmable --.

Signed and Sealed this

Eighteenth Day of September, 2007

JON W. DUDAS
*Director of the United States Patent and Trademark Office*